US006163930A

United States Patent [19]

King

[11] Patent Number: 6,163,930

[45] Date of Patent: Dec. 26, 2000

[54] HIDDEN HINGE FOR USE WITH COMPOSITE MATERIALS AND A CABINET MADE THEREFROM

[76] Inventor: Ron E. King, 4310 Whispering Oaks Cir., Granite Bay, Calif. 95746

[21] Appl. No.: 09/181,434

[22] Filed: Oct. 28, 1998

Related U.S. Application Data

[60] Provisional application No. 60/082,781, Apr. 23, 1998.

[51] Int. Cl.[7] ..... E05D 5/00

[52] U.S. Cl. ..... 16/382; 16/252; 16/388; 16/237

[58] Field of Search ..... 16/382, 252, 271, 16/272, 388, 390, 236, 237, 238; 312/326, 327, 328, 329; 411/427, 176, 160, 185–189

[56] References Cited

U.S. PATENT DOCUMENTS

| | | | |
|---|---|---|---|
| 2,460,721 | 2/1949 | Thompson | 411/427 |
| 3,270,610 | 9/1966 | Knowlton | 411/427 |
| 3,590,419 | 7/1971 | Dargene | 16/382 |
| 4,177,540 | 12/1979 | Gorton . | |
| 4,281,699 | 8/1981 | Grube | 411/176 |
| 4,365,385 | 12/1982 | Cotoh | 16/382 |
| 4,543,763 | 10/1985 | Ernst et al. | 411/427 |
| 4,710,081 | 12/1987 | Overhues | 411/161 |
| 4,842,463 | 6/1989 | Landt | 411/188 |
| 5,067,200 | 11/1991 | Stowell et al. | 16/382 |
| 5,195,854 | 3/1993 | Magayama | 411/176 |
| 5,392,493 | 2/1995 | Youngdale . | |
| 5,414,896 | 5/1995 | Domenig | 16/237 |
| 5,517,724 | 5/1996 | Beneke . | |
| 5,588,181 | 12/1996 | Sutton | 16/382 |
| 5,733,082 | 3/1998 | Schrader | 410/115 |

OTHER PUBLICATIONS

Amerock Brochure—Relevant pages showing a demountable exterior hinge produced by Amerock, Inc.

*Primary Examiner*—Chuck Y. Mah
*Attorney, Agent, or Firm*—Thomas R. Lampe

[57] ABSTRACT

A hidden interior hinge for use in manufacturing cabinets and other furniture. When installed this hinge is fully hidden from exterior view and therefore does not detract from the exterior aesthetic appearance of a piece of furniture. This hinge is especially suitable for use in manufacturing cabinets from composite materials such as multi-density fiber (MDF) or particle board as it incorporates a cabinet wing assembly which grips a cabinet body between a support plate and a connecting plate, the support plate and connecting plate engaging with a routered cutout in a cabinet body and being tightened together and capturing the cabinet material therebetween.

2 Claims, 4 Drawing Sheets

HIDDEN HINGE FOR USE WITH COMPOSITE MATERIALS AND A CABINET MADE THEREFROM

CROSS REFERENCE TO RELATED APPLICATIONS

This application claims the benefit of U.S. Provisional Application No. 60/082,781, filed Apr. 23, 1998.

FIELD OF THE INVENTION

This invention pertains generally to hinges and furniture, and, more specifically, to a hidden hinge for use in cabinets constructed from multi-density fiber board (MDF) or particle board.

BACKGROUND

Mass production furniture making has become commonplace. While a segment of the market still caters to niche customers willing to pay for handcrafted furniture, the majority of consumers now purchase middle to low-cost furniture, manufactured in large quantities, and sold through large outlets and home improvement stores. The search for cheaper building materials for manufacturing furniture has accompanied this move to mass production. Two preferred low-cost furniture building materials in present use are particle board and multi-density fiber board (MDF).

Particle board is comprised of wood chips mixed with glue-like binders and pressed into square shapes to form a composite board. MDF is comprised of fine sawdust mixed with binders and extruded into composite boards. Both particle board and MDF can be laminated with various wood layers or washable, scratch-proof exterior surfaces. These exterior surfaces give any furniture constructed therefrom the exterior appearance of fine wood or laminate, even though composite MDF or particle board is underneath.

In the area of cabinet making, hinged doors must be hung from the body of the cabinet. When cabinets were mainly constructed from solid woods, hinges using screws were adequate for hanging the cabinet doors and holding them onto the body of the cabinet through years of use. For many years, all hinges were of an "exterior variety", meaning that the hinge could be seen from the exterior of the cabinet. In recent years, hidden, "interior" hinges, have become popular, these types of hinges not being visible from the exterior of the cabinet. Hidden hinges are also popularly known as "European" style hinges, because most of these hinges were pioneered in Europe.

There presently exists U.S. patents which disclose and claim hidden hinges. Typical examples are those seen in U.S. Pat. Nos. 5,392,493 (Youngdale); 4,177,540 (Gorton); and 5,517,724 (Beneke). The hidden hinges disclosed in these patents are for wooden cabinets and comprise a recessed cup and screws to hold the hinge to the cabinet body. The recessed cup is embedded into the wood of the cabinet door and allows the pivot arm of the hinge a measure of space to rotate into, upon opening or closing the cabinet door. A support plate opposite the recessed cup, fastens with screws to the cabinet body, and serves as the anchor point for the pivot arm. While this design works well in solid wood cabinets, it is inadequate for cabinets built from composite materials such as particle board or MDF.

It has been found that if the prior art hinges previously described are used with composite materials, the support plate loosens over time, as the screws loosen. Unfortunately, once the screws loosen in particle board or MDF, they cannot be re-tightened. In fact, attempts at re-tightening screws in composites tends to cause them to loosen more, and eventually fall out completely.

A "demountable" exterior hinge manufactured by Amerock, Inc. of Rockfield, Ill., provides a hinge which remains solidly coupled to an MDF or particle board cabinet door through years of use. This hinge requires that two cavities be routered into the edge of a cabinet door at top and bottom locations with a router bit. The exterior demountable hinge is comprised of a visible, decorative, pivot pin located between the cabinet body and door. A bracket extends from the pivot pin and mounts to the body of the cabinet. An arm extends from the pivot pin, opposite the bracket, and couples to the cabinet door. Unlike the other prior art hidden hinges previously described herein, the arm does not have a support plate fastened with screws. Instead, the arm ends in a "door wing" comprised of a half-moon-shaped "connecting plate" bolted to a support plate. The connecting plate and support plate extend from the second arm in a parallel relation. A bolt holds the support plate and connecting plate together and spaces them apart with a small gap. The connecting plate slides into the cutout made in the cabinet door. A channel made by a router bit extends from the edge of the cabinet door to about halfway into the cutout, this channel for accommodating the bolt. The support plate rests upon the inside surface of the cabinet door. When the bolt is tightened, a portion of the composite material is "sandwiched" in the gap separating the connecting plate and the support plate, thereby holding the cabinet door solidly upon the exterior hinge. The doorwing does not rely on screws and does not have the attendant problems previously described regarding screw fastening to composites.

Presently, while the Amerock exterior hinge works well in particle board and MDF, there have been no similar hidden interior "European style" hinges which have performed similarly well. The Amerock hinges are not designed for hidden interior applications. Also, the Amerock hinges are designed for use in cabinets having a solid wood body and either composite or wood doors, because the bracket of the Amerock hinge is coupled with screws, which would be inadequate for coupling to a cabinet body made of composite material for reasons heretofore described.

The foregoing discussion reflects the state of the art of which the inventor is aware, and is tendered with a view toward discharging the inventor's acknowledged duty of candor in disclosing information which may be pertinent with regards to the patentability of the present invention. It is respectfully stipulated, however, that the disclosed information does not teach or render obvious, singly or when considered in combination, the inventor's claimed invention.

SUMMARY OF THE INVENTION

This invention relates to a hidden interior hinge for use in any type of furniture, but which has special utility in the manufacture of cabinets made from composite materials, such as particle board and MDF. This hinge remains hidden from exterior view when fully installed, preserving the exterior aesthetics of any cabinet or piece of furniture it is used in. This hinge is comprised of a door coupler which is preferably a cup for recessing into a cabinet door, a pivot arm which is rotatably coupled to the cabinet coupler at its proximal end, and a cabinet wing coupler which couples to the pivot arm at its distal end. The cabinet wing coupler engages a router channel and cutout fashioned into the cabinet body. The cabinet wing coupler is preferably comprised of a support plate and a connecting plate coupled with a bolt fastener, wherein a gap separates the support plate and connecting plate. Upon full and proper registration with the cutout, the cabinet wing coupler is tightened, capturing a portion of the cabinet body material within the gap separating the support plate and connecting plate. The cabinet wing coupler can be loosened and re-tightened if necessary; a procedure which cannot be done with standard screw fasteners in composite material.

The hinge described herein results in a savings in the amount of time necessary to produce the typical mass produced cabinet. Additionally, this hinge allows much smaller widths of material to be used. For example, the typical mass-produced cabinet which uses screw-in hinges present in the prior art must use ¾" MDF or particle board material to allow enough depth for the screws to bite into the material and hold fast. In thinner widths, the prior art hinges fail, as the screws become loose and fall out. The present invention allows much smaller widths of material to be used and can be used reliably in MDF or particle board having as low as ⅜" width. This use of thinner material allows more cabinets to be made from the same amount of material, resulting in added profit to a manufacturer and less impact on the environment because less wood products are required to build a cabinet with the hinge invention disclosed herein.

As such, the following objects and advantages are achieved by this invention:

It is an object of this invention to provide a hidden interior cabinet hinge for use with composite cabinet building materials.

It is another object of this invention to provide a hidden interior cabinet hinge which does not become loose in composite cabinet materials over time.

It is another object of this invention to provide a hidden interior cabinet hinge which can be loosened and re-tightened numerous times upon composite cabinet material, without damaging said cabinet material.

It is a further object of this invention to provide a hidden interior hinge for use in all types of furniture and all types of furniture building materials.

Is is still a further object of this invention to provide a hidden interior hinge which allows thinner MDF or particle board to be used to build a reliable cabinet, thereby resulting in a lower impact on the environment from the use of fewer wood products.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
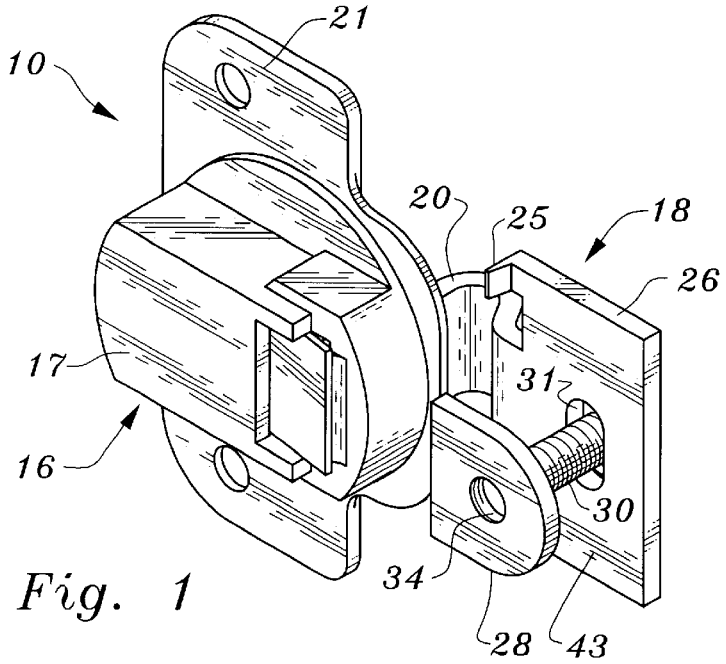
FIG. 1 is a perspective view of the preferred embodiment of the hidden hinge which is the present invention.
Figure 2:
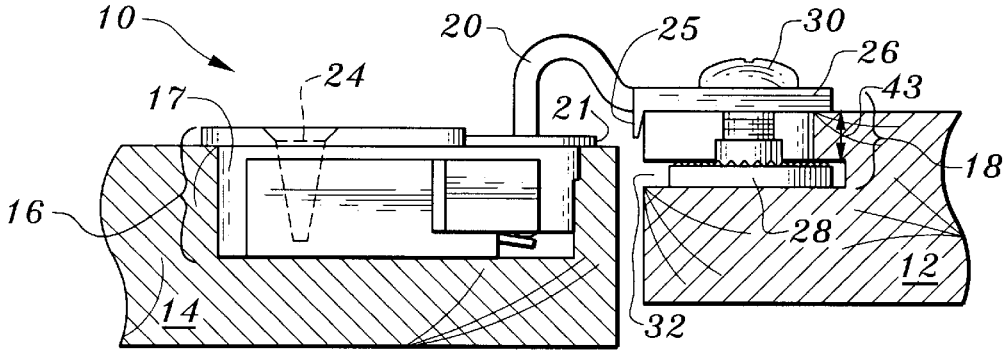
FIG. 2 is a side view of the hidden hinge mounted in a cabinet shown in a cutaway view, with the cabinet door in an open position.
Figure 3:
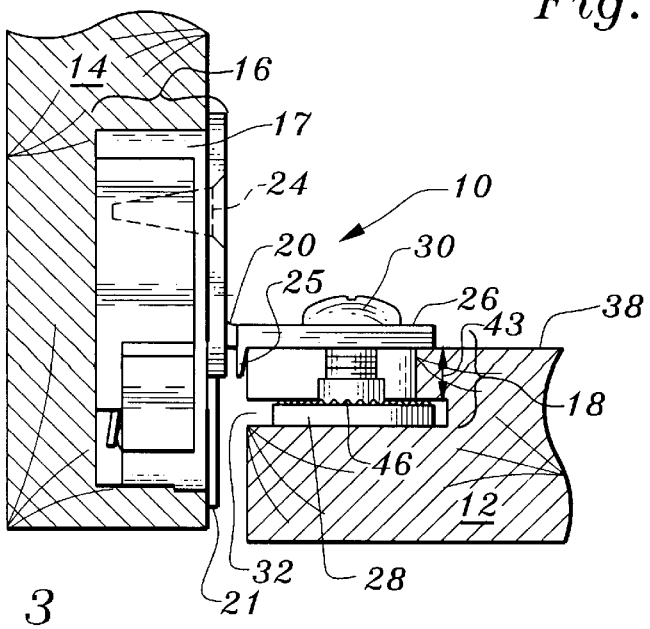
FIG. 3 is a side view of the hidden hinge mounted in a cabinet shown in cutaway view, with the cabinet door in a closed position.
Figure 4:
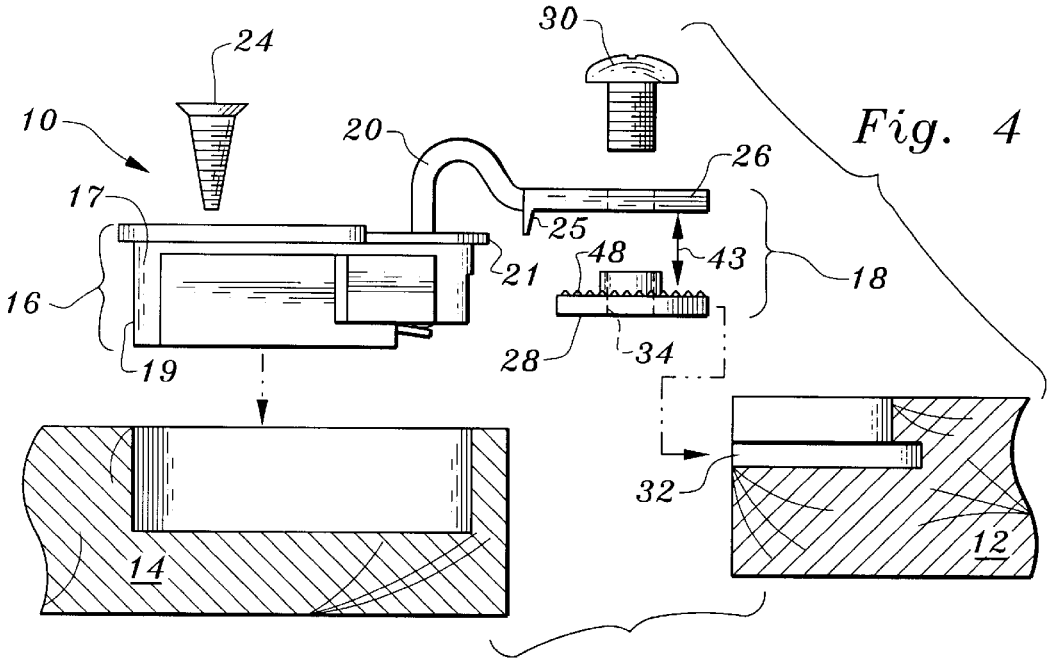
FIG. 4 is an exploded side view of the hidden hinge, the hinge being shown as detached from a cabinet shown in cutaway; this view also shows the cup component of cabinet coupler as having ridges for better gripping of cabinet material.

Referring more specifically to the drawings, for illustrative purposes, the present invention is embodied in the hidden interior hinge 10 shown generally in FIGS. 1, 2 and 3, attached to a cabinet body 12 and cabinet door 14. In FIG. 4, hidden hinge 10 is illustrated in an exploded view showing the hinge components separated from the cabinet body and door. Hidden hinge 10 is comprised of a door coupler 16 which attaches hinge 10 to the cabinet door 14 of cabinet, and a "cabinet wing" coupler 18 for attaching hinge 10 to cabinet body 12. A pivot arm 20 joins door coupler 16 to cabinet wing coupler 18 at its proximal and distal ends, respectively. Door coupler 16 is preferably comprised of a cup 17 as shown in FIG. 2, or similar cavity, which can be recessed into cabinet door 14, the cavity providing space for pivot arm 20 to retract into, when cabinet door 14 is closed upon cabinet body 12, as shown in FIG. 3. Pivot arm is rotatably coupled to cup 17 and can operate on a cam for smooth and trouble free opening and closing of cabinet door 14. Ridges or threads 19 can surround the exterior of cup 17 as shown in FIG. 4 to provide extra surface area for attaching to composite materials such as particle board or MDF. Alternately, door coupler 16 can include flanges 21 which border cup 17 and allow a screw 24 to be placed, thereby holding cup solidly recessed within cabinet body 12.

As shown in FIG. 2, when cabinet door 14 is opened fully, it approximates a 180 degree relation to cabinet body 12, at which point pivot arm 20 is at its most extended position in relation to cup 17. Also, as shown in FIG. 2, in this fully extended position of pivot arm 20, support plate 26 on cabinet body 12 approximates a 180 degree positioning in relation to cup 17. Door coupler 16 need not be limited to the cup configuration shown in the drawings. A cup configuration was chosen in the preferred embodiment because this type of door coupler has been found to be most reliable in fastening to particle board and MDF cabinets, while remaining hidden from view. Consequently, any other type of hidden interior hinge which uses any type of door coupler and which can reliably attach to a particle board or MDF door and which also incorporates the cabinet wing coupler described herein would meet the requirements of this invention.

Cabinet wing coupler 18 is attached to pivot arm 20 and is comprised of a support plate 26 and a connecting plate 28, wherein a bolt 30, or related fastener, fastens support plate 26 and connecting plate 28 together. While a bolt 30 is shown in the figures as a means for bringing support plate 26 and connecting plate 28 together in a tightening relation, any reliable means which brings support plate and connecting plate together against cabinet body 12 in a tightening relation is intended to be within the scope of this invention. A bolt fastener has the advantage of being able to be loosened and re-tightened should improper registration of connecting plate and support plate on cabinet body 12 occur.

Support plate 26 is preferably a stationary continuation of pivot arm 20, having guides 25 which help register support plate precisely against the edge of the face of cabinet body 12 as shown in FIG. 2. Support plate 26 also includes a hole or an open channel 31 as shown in the figures, for placing bolt fastener 30. Connecting plate 28 is preferably partially, or wholly, movable so that it can be maneuvered into cutouts 32 routered into cabinet body 12. Here, as shown in FIG. 4, connecting plate 28 is a separate piece from pivot arm 20 and has a threaded hole 34 through its center for receiving bolt fastener 30.

Figure 5A:
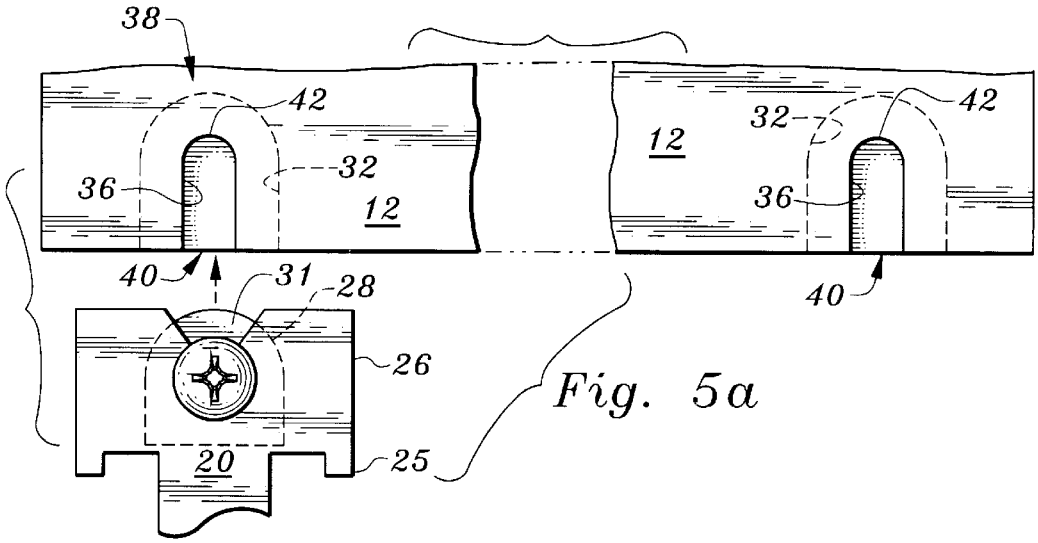
FIGS. 5*a–b* are a plan view and a side view, respectively, of the preferred embodiment of cabinet wing assembly prior to being inserted into a cabinet body.
Figure 5B:
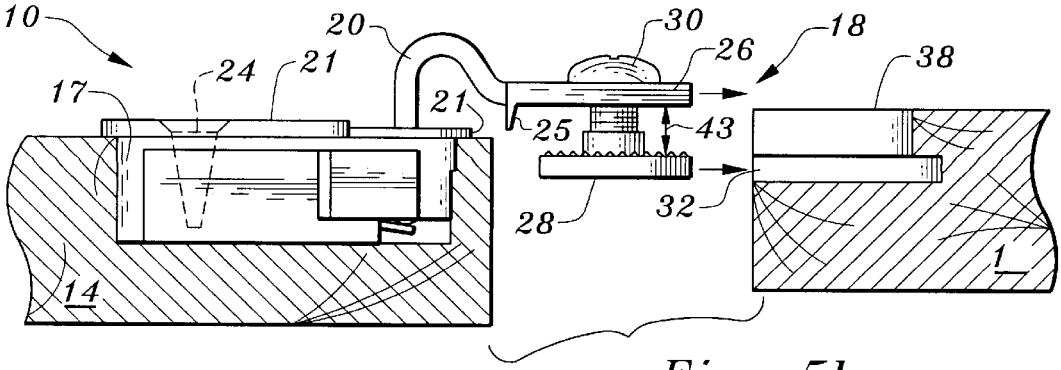

In FIGS. 5*a–b*, cabinet body 12 and corresponding cutouts 32 are shown to illustrate the operation of cabinet wing coupler 18. Connecting plate 28 inserts into cutout 32. Cutout 32 is preferably cut into cabinet body 12 by an AM-48100router bit, this bit leaving a router channel 36 through the center of cutout 32. Connecting plate 28 slides into cutout 32 while support plate 26 slides into position along the top inside surface 38 of cabinet body 12. Bolt fastener 30 also enters the open end 40 of channel 36 and slides therein until it bottoms out against the closed end 42 of router channel 36. As seen in FIGS. 2 and 3, once cabinet wing coupler 18 is in place, cabinet body 12 is positioned in a gap 43 between connecting plate 28 and support plate 26 in a type of "sandwiching" relation. This "sandwiching" relation allows a large surface area of cabinet body 12 to be gripped at one time by connecting plate 28 and support plate 26, thereby holding cabinet body 12 onto pivot arm 20 without screws. Connecting plate 28 and support plate 26 can also be loosened and re-tightened, numerous times, on composite cabinet body 12, which is difficult to do with screws, or similar prior art fasteners, which tend to work loose from composite cabinet materials.

Figure 6A:
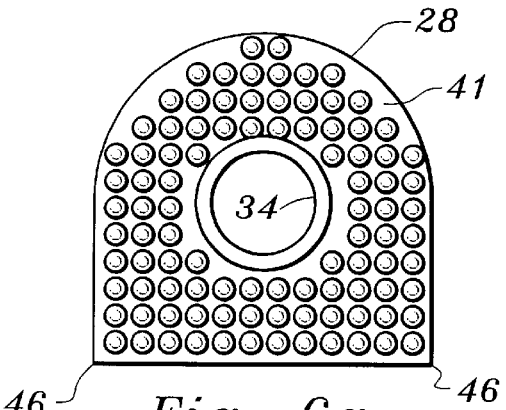
FIGS. 6*a–c* are a top plan view, a rear view and a side view respectively of the preferred connecting plate component of the present invention.
Figure 6B:
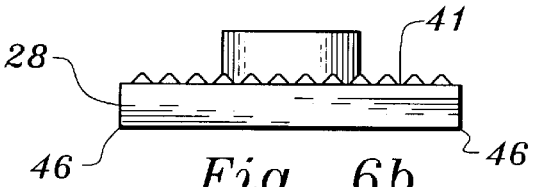
Figure 6C:
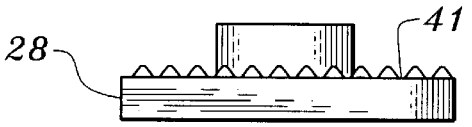

FIGS. 6*a–c* present a preferred embodiment of connecting plate 28. Connecting plate 28 includes a rounded front and squared-off rear approximate to the shape of cutout 32 as describe herein. The rounded front allows connecting plate 28 to slide easily and unobstructed into cutout 32. The squared-off rear helps prevent connecting plate 28 from rotating to an improper position within cutout 32, as the corners 46 tend to catch on the sides of cutout 32 and stop connecting plate 28 from rotating further. Additionally, connecting plate 28 preferably has a knurled or scored gripping top surface 41 which bites into the cabinet material upon tightening, and further prevents connecting plate 28 from rotating into an improper position within cutout 32.

Figure 7A:
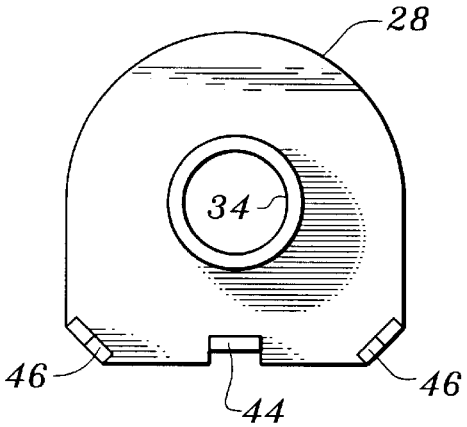
FIGS. 7*a–c* are a top plan view, a rear view and a side view, respectively, of a second embodiment of the connecting plate component of the present invention.
Figure 7B:
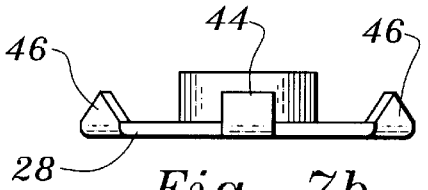
Figure 7C:
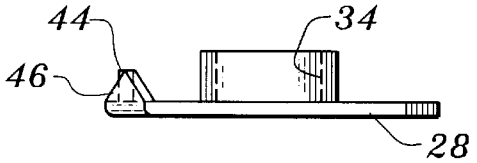

FIGS. 7*a–c* illustrate a second embodiment of connecting plate 28. Here, an upturned center tab 44 serves to catch in channel 36 and thereby prevent connecting plate 28 from rotating and settling in cutout 32 in an improper position. Also, back corners 46 are preferably upturned to allow them to "bite" into cabinet door 14 upon tightening.

Figure 8:
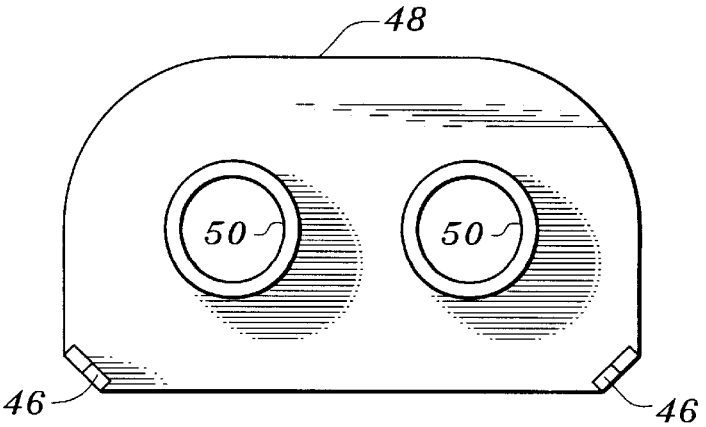
FIG. 8 is a top plan view of a connecting plate component designed for use with two bolt fasteners.

In FIG. 8 a third alternative connecting plate embodiment is represented, this connecting plate 48 having a larger surface area and being fastened by two bolt fasteners in two-threaded holes 50. This alternative embodiment is used with a corresponding larger support plate which can accommodate two bolt fasteners. This embodiment is useful where greater support is needed such as with large and/or heavy cabinet doors hung from a cabinet.

Figure 9:
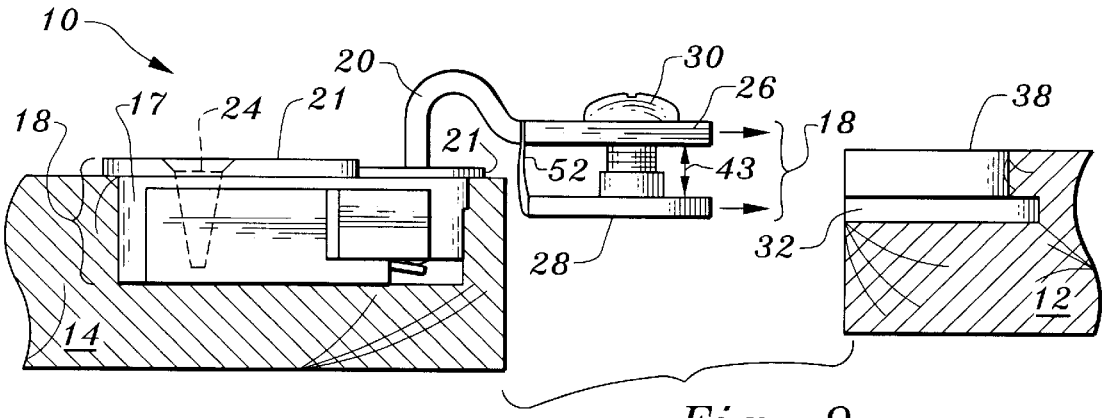
FIG. 9 is a sideview of an alternate embodiment of the invention wherein the connecting plate component and support plate components are joined by a flashing tab.

Other configurations of connecting plate 28 and support plate 26 are possible, such as that shown in FIG. 9, wherein flashing tab 52 joins connecting plate 28 to support plate 26. Flashing tab 52 is positioned centrally so as to fit in router channel 36 of cutout 32. The advantage of this configuration is that connecting plate 28 is joined to support plate 26, and, therefore is less prone to becoming separated and lost from the cabinet wing coupler assembly. Flashing tab 52 could be made pliable enough to allow partial movement of connecting plate 28 toward support plate 26 as bolt fastener 30 is tightened. This configuration is best utilized where the tolerances of cutout 32 are matched closely to the gap 43 between connecting plate and support plate so that upon sliding cabinet wing coupler 18 onto cabinet body 12, an initial close communication of these parts is achieved. In an ideal situation, minimal tightening of bolt fastener 30 would be necessary to achieve a solid coupling between cabinet wing coupler 18 and cabinet body 12.

Figure 10:
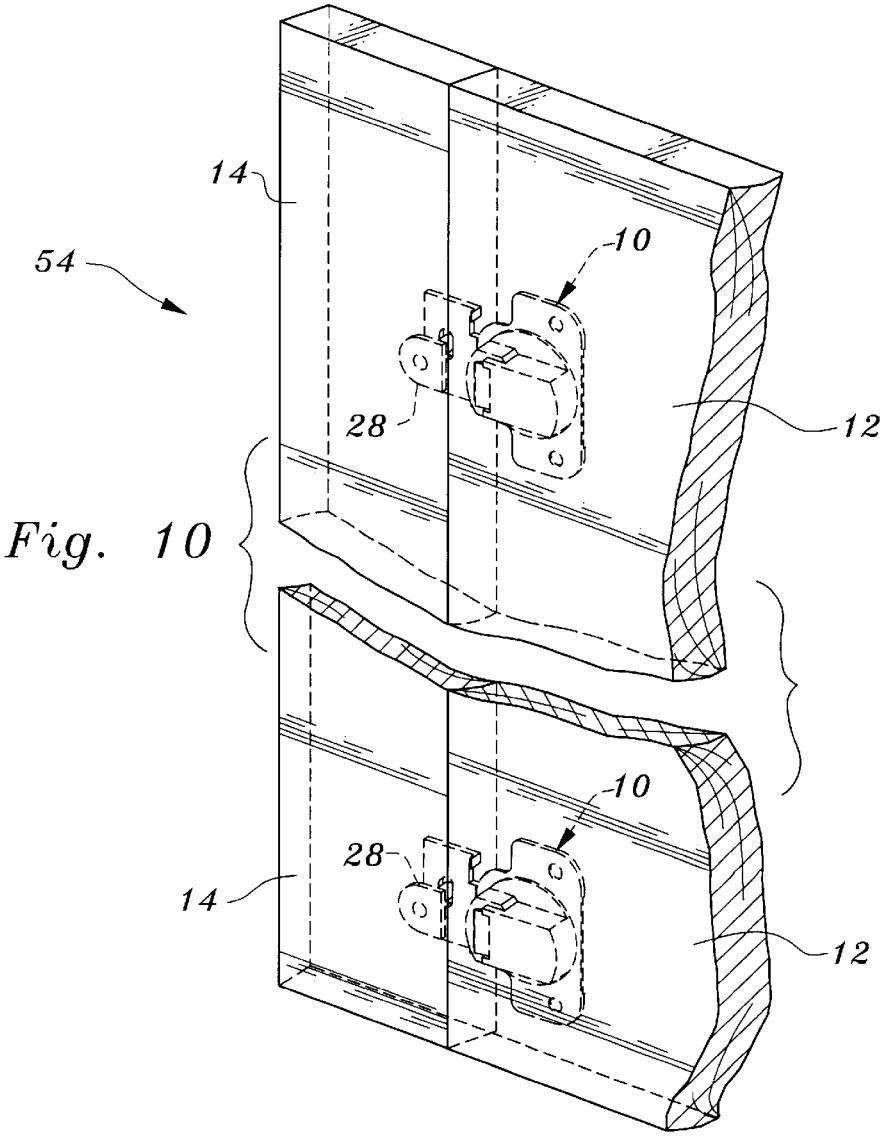
FIG. 10 is a cutaway perspective view of the exterior surface of a cabinet made from the hidden hinge disclosed herein, showing the hinge in phantom and being hidden from exterior view.

A cabinet 54 manufactured using the hinge disclosed herein is shown in FIG. 10. As shown from an exterior view of cabinet 54, hinge 10 is hidden from view. Hinge 10 is shown in phantom so that its interior relation to doors 12 and cabinet body 14 is visible.

Accordingly, it will be seen that this invention provides for a hidden hinge for use in composite furniture materials which remains solidly coupled to the composite throughout years of continuous use. Additionally, this hidden hinge can be removed and then reattached to the composite without the hinge loosening.

Another important advantage provided by the hinge described herein is that it results in a significant savings in the amount of wood products necessary to build the typical mass-produced cabinet. For example, it has been found that where a cabinet using prior art hinges typically requires ¾" MDF or particle board, the hinge described herein can use MDF or particle board in as low as ⅜" widths. This use of thinner wood MDF and particle board materials results in a huge savings in the amount of materials used as well as the amount of scrap which is left over and which must be hauled away to a landfill or recycled.

Finally although the description above contains many specificities, these should not be construed as limiting the scope of the invention but as merely providing illustrations of some of the presently preferred embodiments of this invention. This invention may be altered and rearranged in numerous ways by one skilled in the art without departing from the coverage of the appended claims.

I claim:

1. A hidden interior hinge for use in the manufacture of furniture, and particularly cabinets, the hidden hinge comprising:

a recessed cup for placement into a recessed cutout in a cabinet;

a pivot arm having a proximal end and a distal end, said pivot arm rotatably attached to said recessed cup at said proximal end; and a cabinet wing coupler attached to said pivot arm at said distal end, said cabinet wing coupler comprised of a support plate and a connecting plate, said connecting plate and support plate being coupled with a fastener, said fastener spanning a gap between said connecting plate and said support plate, said fastener enabling said connecting plate and said support plate to be brought close together in a tightening relation, thereby narrowing said gap and allowing cabinet material to be captured tightly within said gap, and said connecting plate including an upturned rear center tab protruding above and forward of a rear edge of said connecting plate.

2. A hidden interior hinge for use in the manufacture of furniture and particularly cabinets, the hidden hinge comprising;

a recessible door coupler for coupling to and recessing within an inside surface of a cabinet door and remaining hidden from exterior view;

a pivot arm having a proximal end and a distal end, said pivot arm rotatably attached to said door coupler at said proximal end; and a cabinet wing coupler attached to said pivot arm at said distal end, said cabinet wing coupler comprised of a top support plate for resting against an inside surface of a cabinet body and a connecting plate, said connecting plate for being hidingly inserted into a cutout fashioned within a cabinet body, said connecting plate and support plate being coupled with a fastener, said fastener spanning a gap between said connecting plate and said support plate, said fastener enabling said connecting plate and said support plate to be brought close together in a tightening relation, thereby narrowing said gap and allowing cabinet material to be captured tightly within said gap, said connecting plate including an upturned rear center tab protruding above and forward of a rear edge of said connection plate.

* * * * *